US010085518B2

(12) United States Patent
Flaherty

(10) Patent No.: US 10,085,518 B2
(45) Date of Patent: Oct. 2, 2018

(54) BOOT TOP OPENING COVERS

(71) Applicant: Joseph Flaherty, Pound Ridge, NY (US)

(72) Inventor: Joseph Flaherty, Pound Ridge, NY (US)

( * ) Notice: Subject to any disclaimer, the term of this patent is extended or adjusted under 35 U.S.C. 154(b) by 26 days.

(21) Appl. No.: 14/569,230

(22) Filed: Dec. 12, 2014

(65) Prior Publication Data

US 2016/0166002 A1 Jun. 16, 2016

(51) Int. Cl.
*A43B 3/00* (2006.01)
*A43C 19/00* (2006.01)
*A45F 5/02* (2006.01)

(52) U.S. Cl.
CPC ..... *A43C 19/00* (2013.01); *A45F 5/02* (2013.01)

(58) Field of Classification Search
CPC ..... A43B 5/002; A43B 3/0031; A43B 5/04
USPC ..... 36/136
See application file for complete search history.

(56) References Cited

U.S. PATENT DOCUMENTS 1,100,758 A * 6/1914 McAuslin ..... A43B 3/0031 36/1
2,908,982 A * 10/1959 Corley ..... A43B 3/02 2/247
3,218,737 A 11/1965 Burtoff
3,306,610 A * 2/1967 Biggs, Jr. ..... A43B 3/0031 36/132
4,507,882 A * 4/1985 Harrell ..... A43B 1/0072 2/247
4,625,340 A * 12/1986 Hernandez ..... A41D 27/20 2/247
4,630,383 A 12/1986 Gamm
4,771,553 A * 9/1988 Smithdeal ..... A43D 3/1416 12/128 R
4,817,306 A * 4/1989 Bayer ..... A43B 3/0031 2/247
4,862,519 A * 9/1989 Bull ..... A45C 1/04 150/112
5,094,016 A * 3/1992 DiVito ..... A43B 1/0036 36/1
5,098,770 A * 3/1992 Paire ..... A41D 31/0027 2/272

(Continued)

FOREIGN PATENT DOCUMENTS

WO 2006079146 A1 8/2006

*Primary Examiner* — Richale Quinn
*Assistant Examiner* — Anne Kozak
(74) *Attorney, Agent, or Firm* — St Onge Steward Johnston and Reens LLC

(57) ABSTRACT

A top covering for a boot includes an anchor having two ends with a length between, the two ends each having an attachment member, the anchor adapted to secure to a front side of the boot. The top covering also includes a pouch having a pocket and two ends with a length between, the two ends each having an attachment member that cooperate with the attachment members on the two ends of the anchor for securing the pouch around the boot, and a fastener for alternately opening and closing the pocket. The top covering further includes a cover adapted to prevent objects from entering the boot and having a tightening member for tightening the cover around the top of the boot when in use, the cover capable of being stored in the pouch when not in use so that it does not impede the wearer.

19 Claims, 7 Drawing Sheets

(56) References Cited

U.S. PATENT DOCUMENTS 5,133,607 A * 7/1992 Bonke ..... B65F 1/0006 220/495.11
5,148,949 A * 9/1992 Luca ..... A01K 27/006 222/175
5,150,824 A * 9/1992 Alvarez ..... A45F 3/02 224/586
5,162,032 A * 11/1992 Dohner ..... A43B 3/0031 482/105
5,165,182 A * 11/1992 Michael ..... A43B 3/24 36/1.5
5,170,503 A * 12/1992 Hightower, Jr. ..... A41D 17/02 2/22
5,269,023 A * 12/1993 Ross ..... A41D 13/081 126/204
5,285,833 A * 2/1994 Haxby ..... A45C 1/04 150/102
5,294,031 A * 3/1994 Volpei ..... A45F 3/00 224/192
5,311,679 A * 5/1994 Birch, Sr. ..... A43B 3/0031 2/919
D347,940 S * 6/1994 Linscott ..... D3/226
5,351,370 A * 10/1994 Fields ..... A43C 7/00 224/222
5,456,393 A * 10/1995 Mathis ..... A43B 5/16 224/148.4
D364,724 S * 12/1995 Bates ..... D2/613
5,505,355 A * 4/1996 Williams ..... A45C 1/04 224/243
5,531,366 A * 7/1996 Strom ..... A45C 1/04 224/153
5,592,953 A * 1/1997 Delao ..... A61F 15/004 128/882
5,596,821 A * 1/1997 Solo ..... A43B 1/0036 206/37.1
5,623,772 A * 4/1997 Sunderland ..... A43B 3/0031 219/211
5,642,573 A * 7/1997 Brown ..... A41D 17/00 36/132
5,694,703 A * 12/1997 Diaz ..... A43B 3/163 36/7.1 R
5,716,388 A * 2/1998 Petelle ..... A61F 7/02 126/204
5,729,915 A * 3/1998 Khoo ..... A43B 3/16 36/7.1 R
D395,163 S * 6/1998 Huang ..... D3/226
5,787,607 A * 8/1998 Schurch ..... A43B 23/06 36/59 R
5,815,948 A * 10/1998 Dzielak ..... A41D 17/00 2/22
5,829,653 A * 11/1998 Kaiser ..... A45F 4/02 2/2.5
5,921,008 A * 7/1999 Ruff ..... A43B 3/00 36/136
5,970,633 A * 10/1999 Jones ..... A43B 1/0036 36/136
5,988,467 A * 11/1999 Brustein ..... A43B 3/0031 224/222
6,016,772 A * 1/2000 Noyes ..... A01K 5/0114 119/61.56
6,182,382 B1 * 2/2001 Skinner ..... A43B 5/0425 12/128 R
6,389,599 B2 * 5/2002 Spiegel ..... 2/91
6,415,529 B1 * 7/2002 Kelley ..... A43B 3/0031 36/2.6
6,449,881 B1 * 9/2002 Assaf ..... A43B 3/0031 150/143
6,457,260 B1 * 10/2002 Roelofs ..... A41D 17/00 2/23
6,477,788 B1 * 11/2002 Chen ..... A43B 3/166 36/1.5
6,668,428 B2 * 12/2003 Moeller ..... A44B 11/001 24/163 R
6,679,405 B2 1/2004 Zalis-Hecker et al.
6,732,834 B2 * 5/2004 Colorado ..... A62B 35/0037 182/3
6,782,576 B1 * 8/2004 Valencic ..... B24D 15/06 7/158
6,817,498 B1 * 11/2004 Spratt ..... A43B 3/0031 224/191
D509,057 S * 9/2005 Bollig ..... D3/226
D595,928 S * 7/2009 Swanson ..... D2/611
7,937,852 B1 * 5/2011 Krehbiel ..... A41D 17/005 2/22
8,099,794 B2 * 1/2012 Carstens ..... G06F 1/163 2/16
D680,320 S * 4/2013 Kryklywicz ..... D3/215
8,607,365 B2 * 12/2013 Watley ..... A41D 17/00 2/242
8,919,629 B2 * 12/2014 Moreau ..... A45F 5/004 2/66
D743,141 S * 11/2015 Kafka ..... D2/611
9,314,066 B1 * 4/2016 Troconis ..... A43B 3/248
2001/0045469 A1 * 11/2001 Hooglander ..... A43B 3/0031 235/492
2002/0008125 A1 * 1/2002 Caputi ..... A45C 13/30 224/257
2002/0174565 A1 11/2002 Roelofs
2003/0000053 A1 * 1/2003 Rooney ..... A43B 1/0054 24/712.6
2003/0029470 A1 * 2/2003 Srivastava ..... A45D 8/40 132/274
2003/0126768 A1 * 7/2003 Hutt ..... A43B 3/0031 36/136
2004/0088887 A1 * 5/2004 Kim ..... A43B 1/0081 36/89
2005/0178027 A1 * 8/2005 Hernandez Martinez-Portillo ..... A43B 3/0031 36/72 R
2005/0183293 A1 * 8/2005 Mick ..... A43B 23/00 36/136
2005/0198872 A1 * 9/2005 Correa ..... A43B 3/0031 36/136
2006/0027615 A1 * 2/2006 Masi ..... A43B 3/0031 224/222
2006/0042127 A1 * 3/2006 Shattuck ..... A43B 3/02 36/136
2007/0095870 A1 * 5/2007 Griffith ..... A45C 13/30 224/219
2008/0018066 A1 * 1/2008 Pickford ..... A43B 1/0081 280/11.3
2008/0022558 A1 * 1/2008 Kaufer ..... A43B 3/0031 36/100
2008/0061095 A1 * 3/2008 Fernandez ..... A43B 1/0081 224/269
2008/0098625 A1 * 5/2008 Salvatore ..... A43B 3/0031 36/132
2008/0098811 A1 * 5/2008 Brandenburg ..... A43B 3/0005 73/431
2008/0290121 A1 * 11/2008 Wise ..... A43B 3/0031 223/113
2008/0307674 A1 * 12/2008 Dean ..... A43B 3/0031 36/89
2009/0007459 A1 * 1/2009 Barnett ..... A43B 3/0031 36/136
2009/0184144 A1 * 7/2009 Kim ..... A45C 3/02 224/258
2010/0252598 A1 * 10/2010 Cragg ..... A45F 3/02 224/579
2010/0254634 A1 * 10/2010 Liu ..... A45C 13/02 383/40
2010/0314425 A1 * 12/2010 Oldfield ..... A45F 5/1046 224/264
2011/0225849 A1 * 9/2011 Zubyk ..... A43B 3/0031 36/136
2012/0110873 A1 * 5/2012 Chen ..... A43B 1/0072 36/136
2012/0152772 A1 * 6/2012 Garner ..... A45F 4/12 206/223

(56) References Cited

U.S. PATENT DOCUMENTS

2012/0168474 A1* 7/2012 Bevier ..... A45C 13/30 224/257
2012/0248161 A1* 10/2012 Chauhan ..... A45F 3/12 224/264
2013/0000155 A1* 1/2013 Romer ..... A43B 3/16 36/136
2013/0086819 A1* 4/2013 LeGear ..... A43B 23/00 36/136
2013/0105529 A1* 5/2013 Simmons ..... A45F 5/02 224/191
2014/0041260 A1* 2/2014 Jewell ..... A41D 17/00 36/2 R
2014/0064823 A1* 3/2014 Benefield ..... A45C 11/00 402/4
2014/0215854 A1* 8/2014 Girard ..... A43B 3/18 36/114
2014/0223639 A1* 8/2014 Betrus ..... A43B 23/24 2/245
2014/0224389 A1* 8/2014 Iwai ..... A45C 3/06 150/109
2014/0368157 A1* 12/2014 Alexander ..... A43B 3/0031 320/107
2015/0040293 A1* 2/2015 Pitman ..... A43B 3/0031 2/245
2015/0096201 A1* 4/2015 Marcon ..... A43B 7/125 36/109
2015/0173460 A1* 6/2015 Cole ..... A43C 19/00 36/72 R
2015/0196093 A1* 7/2015 Knutson ..... A43B 7/02 36/72 R
2015/0305433 A1* 10/2015 Meraw ..... A43B 3/0031 36/137
2015/0305444 A1* 10/2015 Baronia ..... A43B 1/0081 36/72 R
2015/0374063 A1* 12/2015 Jurgeto ..... A43B 3/20 36/72 R
2016/0003269 A1* 1/2016 Russell-Clarke ..... A41F 1/002 24/303
2016/0015157 A1* 1/2016 Nouri ..... A45F 3/16 224/148.2

* cited by examiner

BOOT TOP OPENING COVERS

FIELD OF THE INVENTION

The present teachings relate generally to footwear accessories and, more particularly, to boot top opening covers.

BACKGROUND OF THE INVENTION

A boot is a type of footwear that typically covers the foot and the ankle and extends up a portion of a wearer's leg. A boot has a sole, an upper portion, a tongue, and laces. The sole is on the bottom of the boot and may provide friction to avoid slipping on surfaces. A sole also absorbs and redirects shocks, and provides cushion for the foot. The upper portion extends up from the sole and envelopes the foot for protection and support. Two sides of the upper portion meet at a gap at the top of the boot, which allows the upper portion to open wider for ease of inserting a foot. The tongue is a flap of material in the gap that helps make sure that water, dirt and debris will not enter the boot when worn. The laces go over the tongue and secure the sides of the upper portion to each other to keep the boot tight on the foot.

In use, a wearer inserts a foot into the top opening on the upper portion of the boot. However, when not in use the top opening is typically left uncovered. This presents a problem when boots are left in places where foreign objects (e.g., rain, debris, bugs, etc.) can get inside the boot. For example, when boots become wet or dirty, they are typically left outdoors. In some instances boots may be permanently stored outdoors leaving them exposed to the elements. Even if boots are stored in a location protected from the weather, such as a garage or closet, the interior of the boot is still susceptible to invasion by insects and rodents seeking a protective environment to live.

After a long day of hiking, a wearer typically leaves his or her boots outside of a tent. Unfortunately, this not only exposes the boots to the elements, but provides a desirable enclosure for insects and small animals to hide. When the wearer wants to wear the boot, it can be difficult to determine if the interior has been invaded as the internal toe region is usually difficult to inspect. This is particularly so with boots that have an extended leg portion. It is therefore usually necessary for the wearer to insert a hand into the boot to determine if it is empty. Alternatively, the wearer may insert a foot inside the boot. This can potentially lead to the wearer being bitten by a spider or some other creature that is nesting or has sought refuge within the boot.

Attempts have been made in the past to apply a covering to a boot. For example, U.S. Pat. No. 4,771,553, the content of which is incorporated by reference in its entirety, discloses a boot insert with a skirt that can be removed to cover the opening of the boot. The '553 patent suffers from a number of deficiencies, including that its insert and skirt are not readily storable.

Therefore, it would be beneficial to have a superior system and method for boot top opening covers.

SUMMARY OF THE INVENTION

The needs set forth herein as well as further and other needs and advantages are addressed by the present embodiments, which illustrate solutions and advantages described below.

The system of the present embodiment includes, but is not limited to, an anchor having two ends with a length between, the two ends each having an attachment member, the anchor adapted to secure to a front side of a boot. A pouch has a pocket and two ends with a length between, the two ends each having an attachment member that cooperate with the attachment members on the two ends of the anchor for securing the pouch around the boot, and a fastener for alternately opening and closing the pocket. A cover is adapted to prevent objects from entering the boot and has a tightening member for tightening the cover around the top of the boot when in use, the cover capable of being stored in the pouch when not in use so that it does not impede the wearer.

In another embodiment, the system includes, but is not limited to, an anchor having two ends with a length between, the two ends each having an attachment member, the anchor adapted to secure to a front side of a boot. A pouch has a plurality of pockets and two ends with a length between, the two ends each having an attachment member that cooperate with the attachment members on the two ends of the anchor for securing the pouch around the boot. A survival kit has a plurality of survival gear items, the survival kit capable of being stored in one of the plurality of pockets when not in use. A cover is adapted to prevent objects from entering the boot and has a tightening member for tightening the cover around the top of the boot when in use, the cover capable of being stored in another one of the plurality of pockets when not in use so that it does not impede the wearer.

In still another embodiment, the system includes, but is not limited to, a boot having laces and a pouch adapted for securing to a back side of the boot. The pouch has two ends with a length between, a pocket, and a fastener for alternately opening and closing the pocket. A cover is adapted to prevent objects from entering the boot and has a tightening member for tightening the cover around the top of the boot when in use, the cover capable of being stored in the pouch when not in use so that it does not impede the wearer.

Other embodiments of the system and method are described in detail below and are also part of the present teachings.

For a better understanding of the present embodiments, together with other and further aspects thereof, reference is made to the accompanying drawings and detailed description, and its scope will be pointed out in the appended claims.

DETAILED DESCRIPTION OF THE INVENTION

The present teachings are described more fully hereinafter with reference to the accompanying drawings, in which the present embodiments are shown. The following description is presented for illustrative purposes only and the present teachings should not be limited to these embodiments.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

The present teachings may be used with hiking boots, where the wearer desires a way to protect the hiking boots when not in use. For example, after a long day of hiking the wearer may want to leave the boots outside of the tent/cabin/etc. if they are covered with dirt, wet, or odorous. However, doing so may allow foreign objects such as moisture, dust, insects, and rodents to settle in the boots overnight, although not limited thereto. A system according to the present teachings addresses this problem while at the same time providing convenient storage.

Accordingly, an object of the present teachings is to provide a removable cover for the open top of a boot so as to prevent the entry of unwanted debris, insects and the like, and without modification to the boot. An additional objective is to provide an attractive and useful cover for the boot which utilizes a pouch for carrying additional objects.

In one embodiment, the system according to the present teachings comprises a system having a boot top cover, a removable pouch to store the cover, and an anchor for securing the removable pouch to the boot. When not in use, the cover may be stored in the pouch and secured to the boot so that it is out of the way and does not impede the wearer. When needed, the cover is conveniently located on the boot, so the wearer may simply open the pouch and remove it for immediate use.

Figure 1:
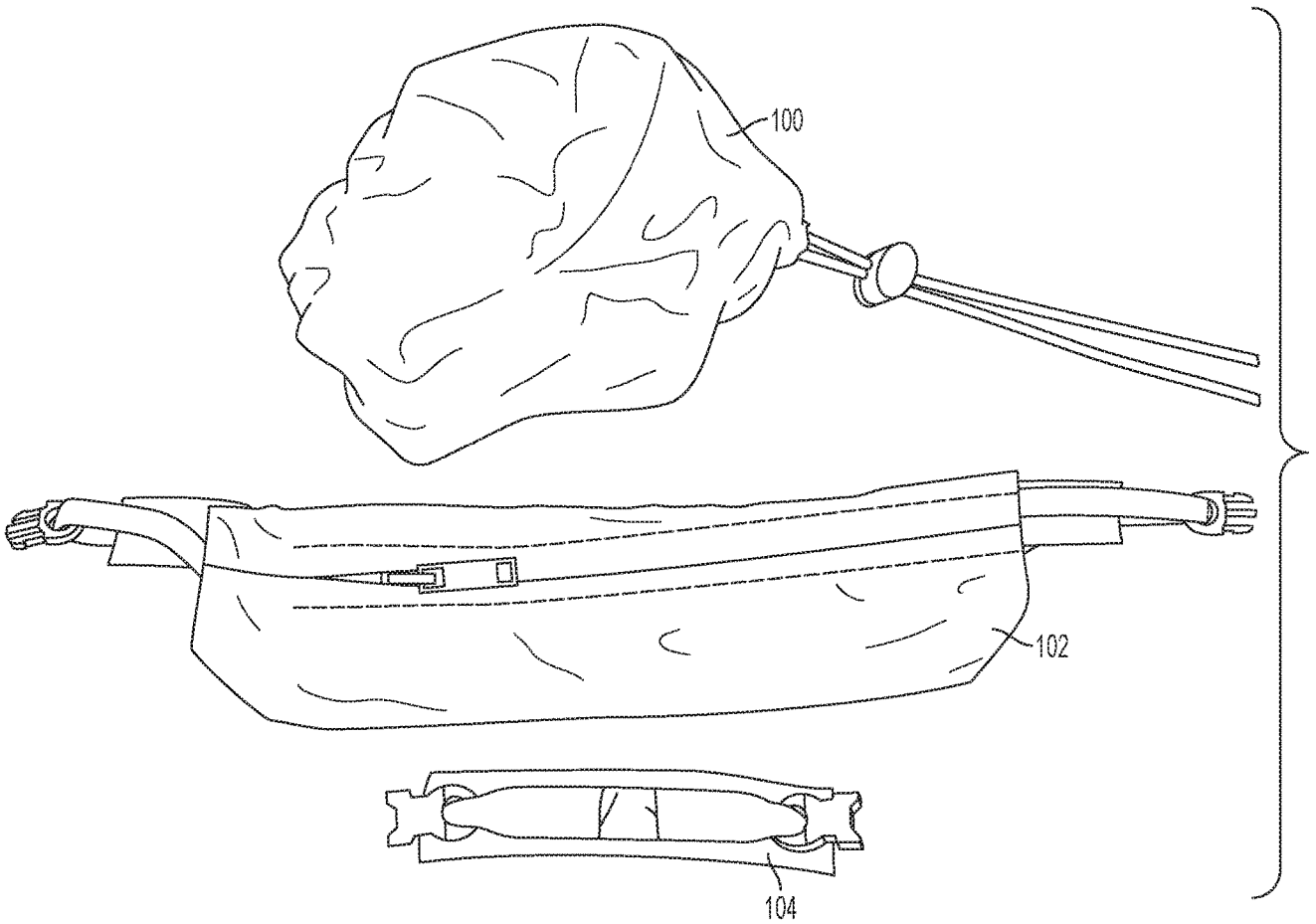
FIG. 1 is one embodiment of boot top covering system according to the present teachings.

Referring now to FIG. 1, shown is one embodiment of boot top covering system according to the present teachings. The system may comprise a boot top cover 100, a removable pouch 102, and an anchor 104. As shown in more detail below, the cover 100 may be stored in the pouch 102 and secured to a boot with the anchor 104.

The elements in the system may match the material on the boot. For examine, for military use the pouch may comprise camouflage material. It may also comprise reflective material. One skilled in the art would appreciate the number of different fabrics, colors, and patterns that may be used without deviating from the present teachings.

Figure 2:
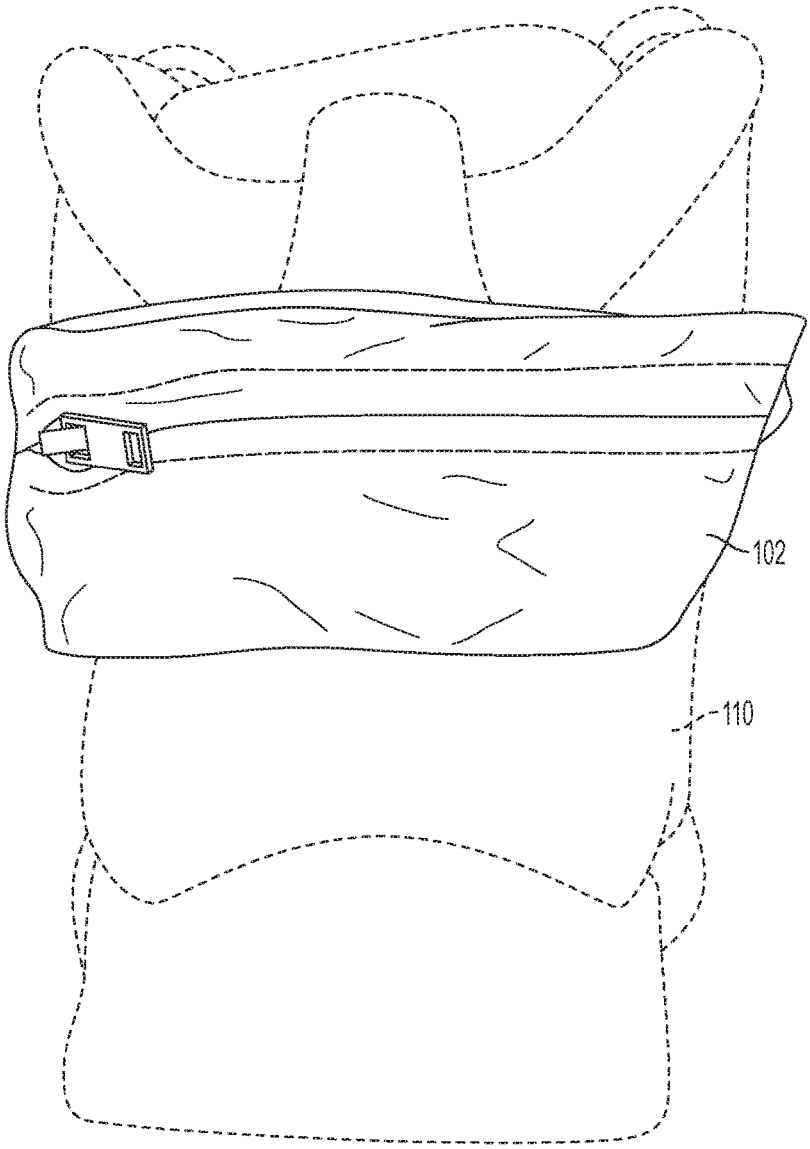
FIG. 2 is a rear view of the system of FIG. 1 attached to a boot.

Referring now to FIG. 2, shown is a rear view of the system of FIG. 1 attached to a boot 110. The cover 100 (not shown) is stored in the pouch 102. The pouch 102 is secured to the rear of the boot 110 so that it does not interfere with the wearer's use of the boot 110, but remains conveniently located for ready accessibility.

Figure 3:
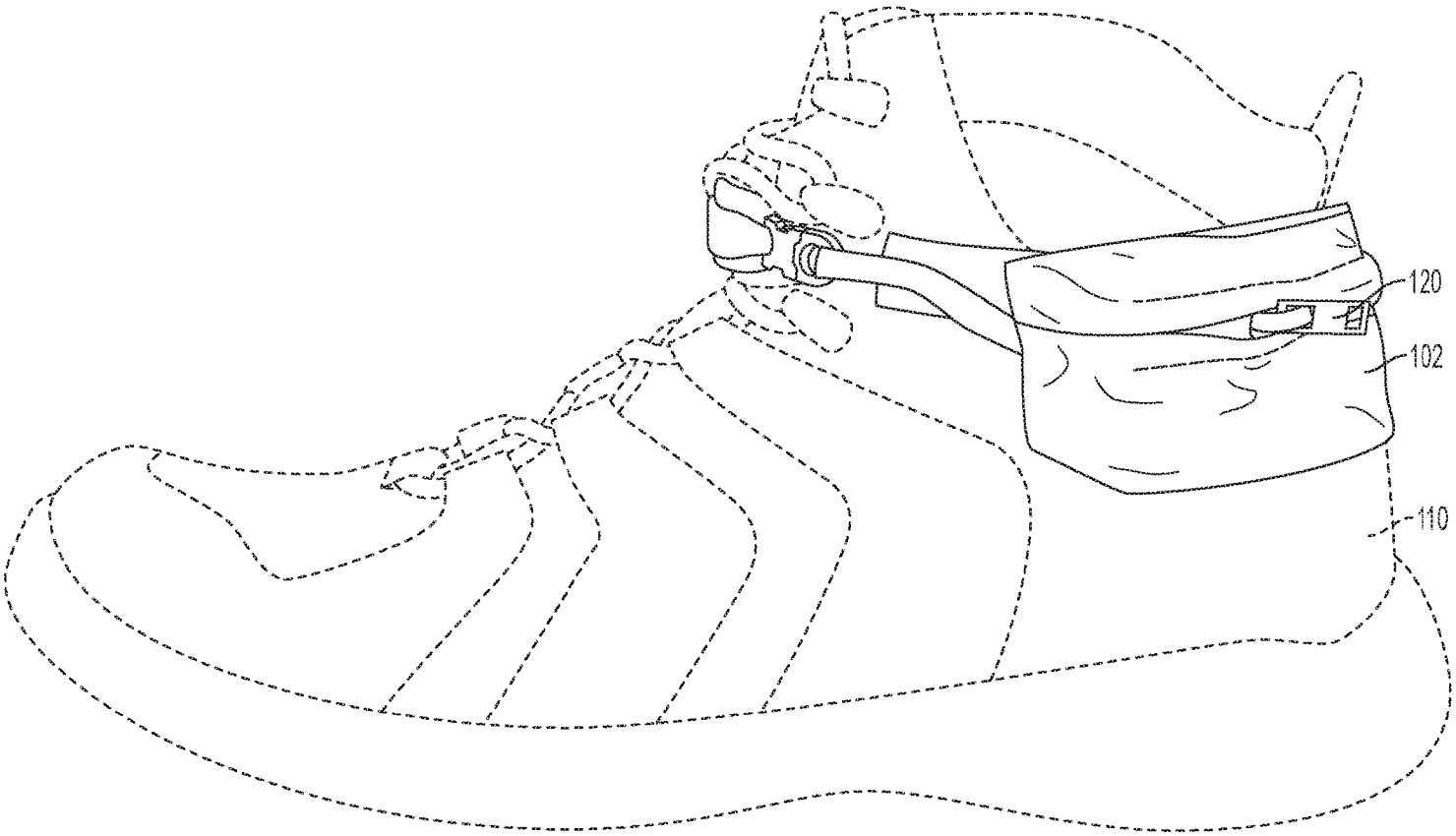
FIG. 3 is a side view of the system of FIG. 1 attached to a boot.

Referring now to FIG. 3, shown is a side view of the system of FIG. 1 attached to a boot 110. The pouch 102 has a fastener 120 for closing the pouch and securing the cover (not shown) therein. The fastener 120 may be a zipper, Velcro™, buttons, clips, or some other device for closing the pouch and the present teaching are not limited to any particular embodiments disclosed herein.

Figure 4:
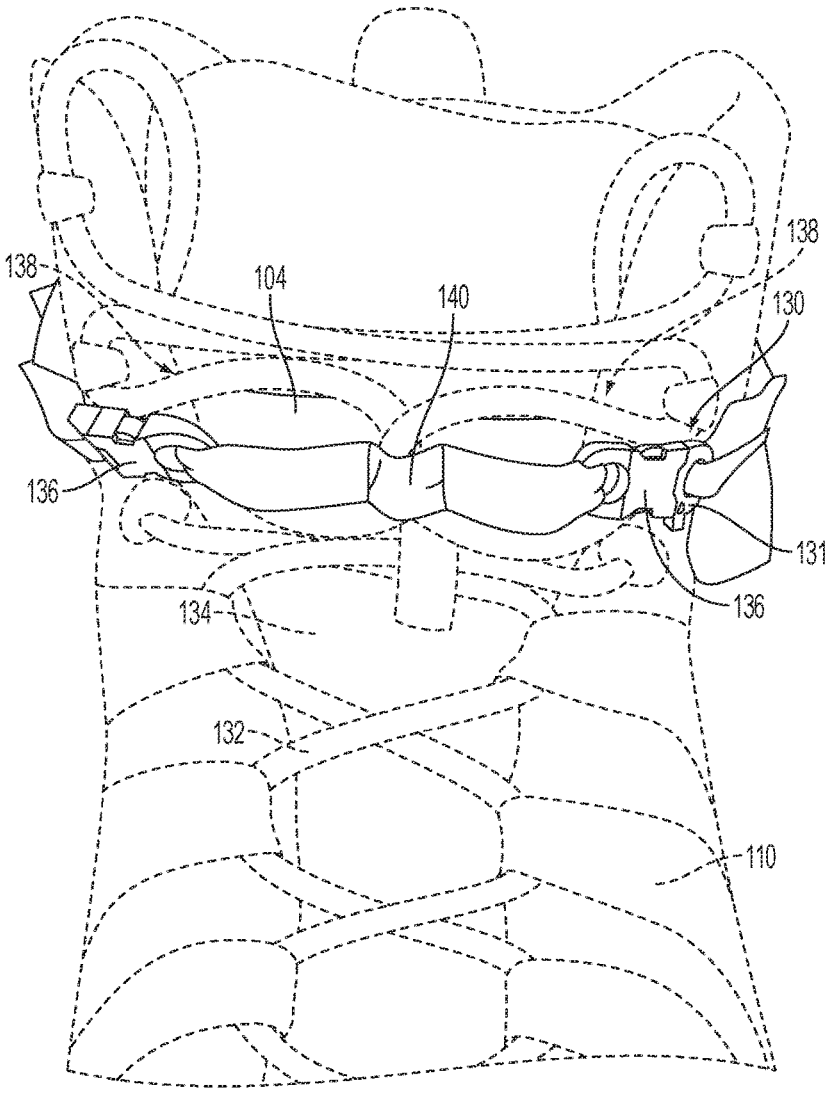
FIG. 4 is close up front view of the system of FIG. 1 attached to a boot.

Referring now to FIG. 4, shown is close up front view of the system of FIG. 1 attached to a boot 110. The anchor 104 may be secured to the boot with the laces 132, although not limited thereto. The anchor 104 may have one or more loops that cooperate with the laces (e.g., allow the laces to pass through) in order to secure the anchor to the boot 110. As shown, the laces 132 pass through a center loop 140 on the anchor 104, and the anchor has extending ends 136 that may be disposed between the tongue 134 and the upper portion 138 of the boot. In one embodiment, the one or more loops 140 may comprise elastic material, although not limited thereto.

The anchor 104 and pouch 102 may have attaching members 130 to connect them to each other. In one embodiment, the attaching members 130 comprise a plastic side release buckle. The attaching members 130 allow the anchor 104 and pouch 102 to be alternately disconnected and reconnected so that the pouch may be easily removed when not in use, although not limited thereto.

Figure 5:
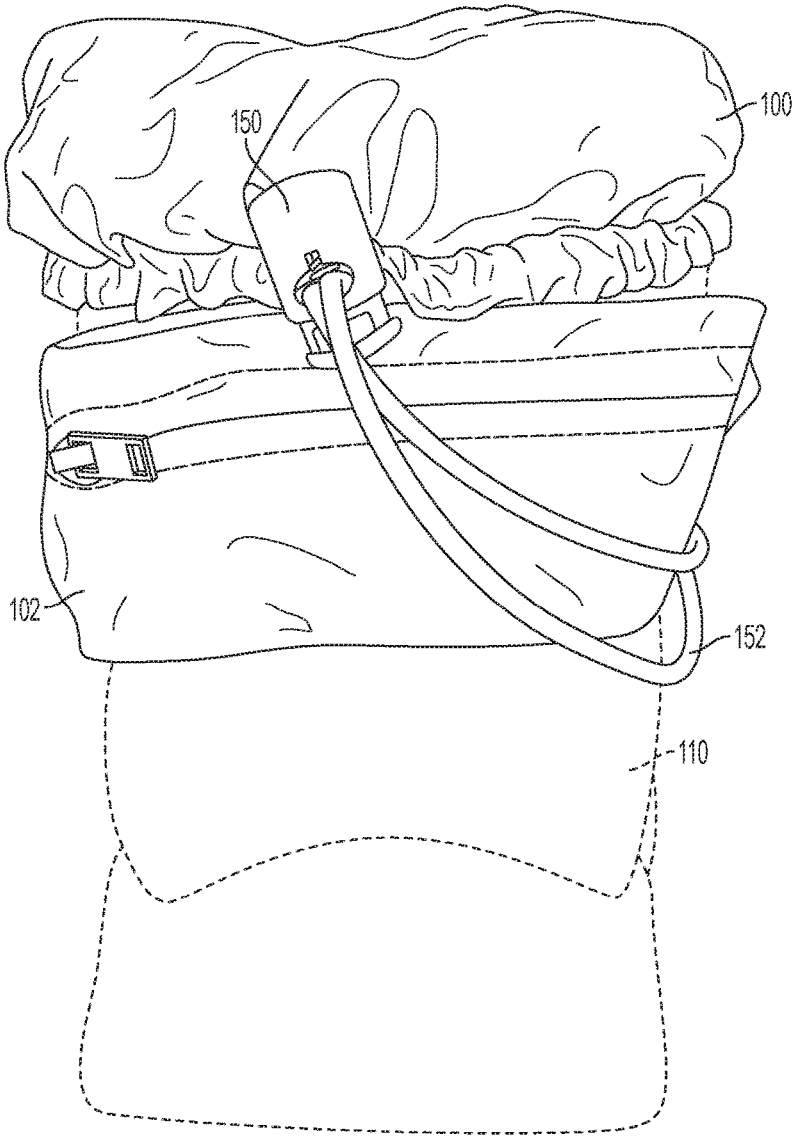
FIG. 5 is a rear view of the system of FIG. 1 attached to a boot where the cover has been placed over the boot top opening.

Referring now to FIG. 5, shown is a rear view of the system of FIG. 1 attached to a boot 110 where the cover 100 has been placed over the boot top opening. The cover 100 may be tightened around the top of the boot 110 with a tightening member 150. In one embodiment, this may be accomplished by pulling a drawstring 152 and securing it with the tightening member 150. In one embodiment, the drawstring 152 comprises elastic material and the tightening member 150 comprises a cord lock.

In one embodiment, the bottom of the cover 100 may interact with the pouch 102 such as, for example, by attaching them to each other (e.g., by Velcro™, zipper, snaps, etc.). This may help secure the cover 100 to the boot 110.

The drawstring 152 and tightening member 150 may make a tight fit between the top of the boot 110 and the cover 100. A poorly fitted cover that is not snug can in some instances still allow foreign objects—rain snow, dirt, debris, insects such as scorpions or spiders, snakes, rodents, and the like—enter the interior of the boot. This may be undesirable by making the boot dirty, but can also result in the wearer getting stung.

Figure 6:
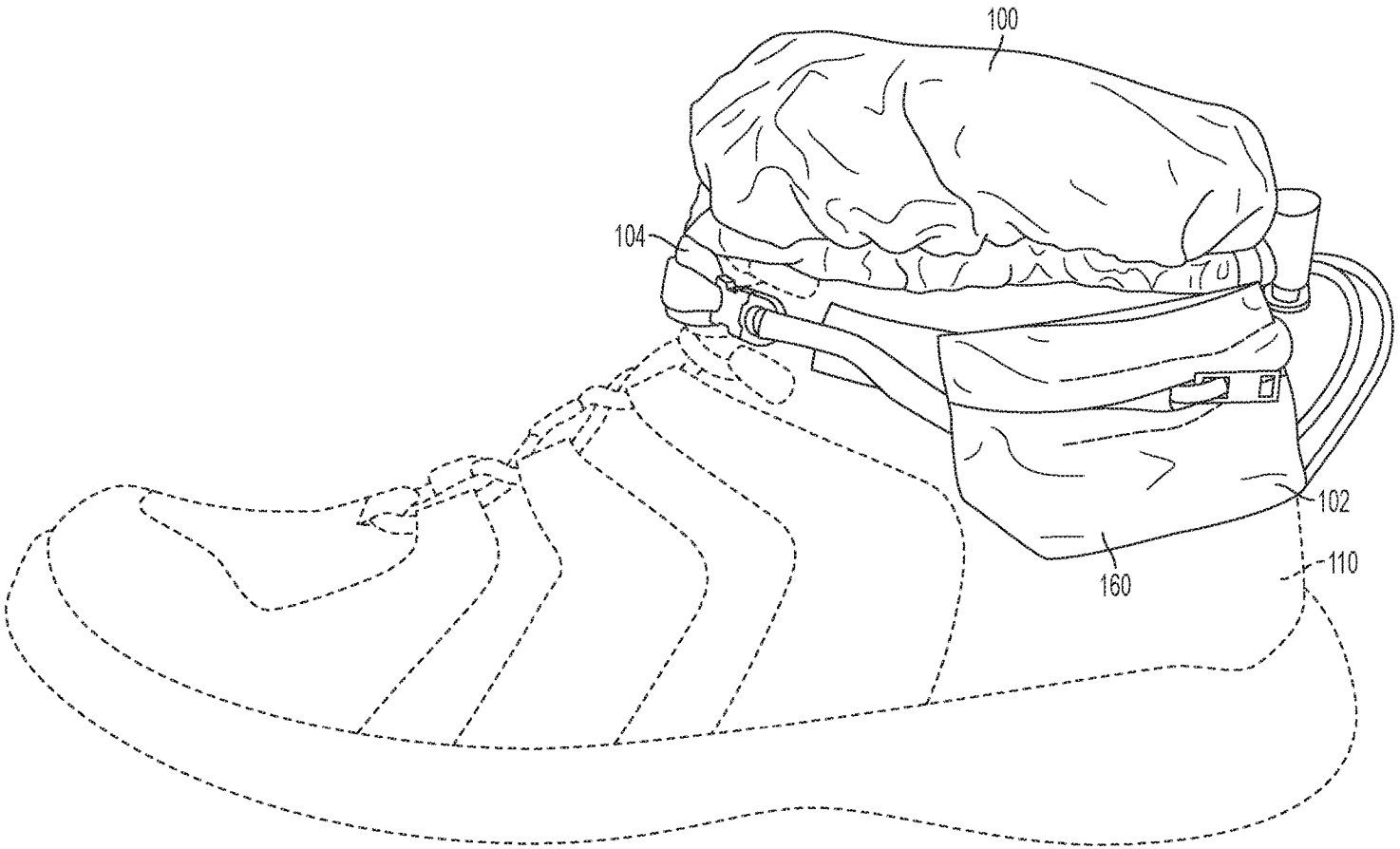
FIG. 6 is a side view of the system of FIG. 1 attached to a boot where the cover has been placed over the boot top opening.
Figure 7:
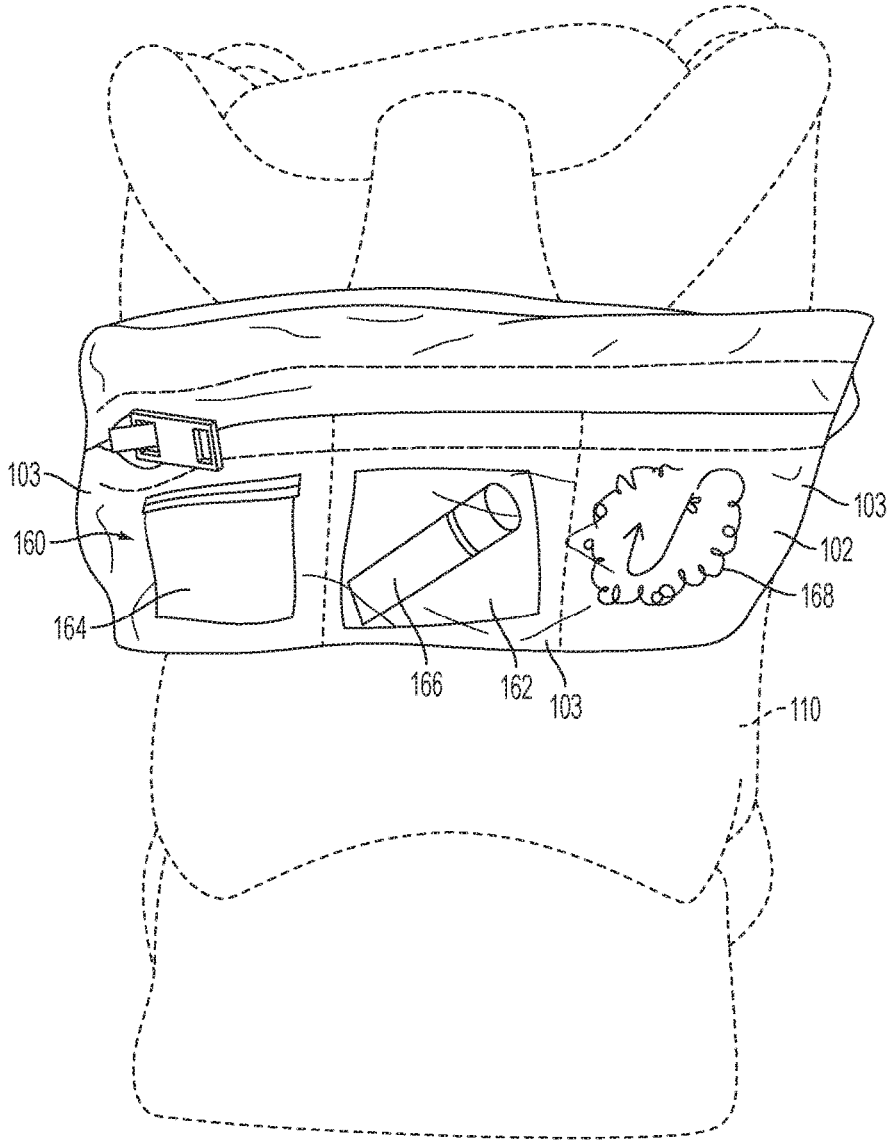
FIG. 7 is a rear view of the system of FIG. 1 attached to a boot with a cutaway view of the pouch to show a plurality of pouches containing survival kit components.

Referring now to FIG. 6, shown is a side view of the system of FIG. 1 attached to a boot 110 where the cover 100 has been placed over the boot top opening. In one embodiment, the cover 100 may extend down below the anchor 104 and pouch 102 to protect them from the elements. In one embodiment, the cover 100 may interact with the anchor such as, for example, by securing to it, as discussed previously.

The pouch 102 may comprise a plurality of pouches 103, each designed to store different objects. These may include a survival kit 160 comprising one or more survival gear items: heat pack, multi-tool, light, saw, signaling mirror 162, survival blanket 164, fire starter, waterproof matches 166, fire tinder (e.g., cotton Ball), snare wire, emergency cord, waxed thread, fishing kit 168, sewing kit, lanyard whistle, pocket guide, etc. The system according to the present teachings (e.g., including survival kit 160) may be readily portable.

In an embodiment comprising a survival kit 160, the attachment members 130 (shown in FIG. 4) may comprise a whistle side release buckle 131, as would be appreciated by one skilled in the art. The buckle is multifunctional in that it also incorporates a whistle or other survival gear item (e.g., reflector, mirror, etc.). Other components of the system may also comprise survival gear items. For example, the drawstring 152 may be removable for use as emergency cord when needed, although not limited thereto.

The pouch 102, cover 100, and/or anchor 104 may comprise water resistant material as is known in the art. They may also be water proof so that, for example, the pouch 102 may serve as an emergency water container, although not limited thereto. In one embodiment, the pouch 102, cover 100, and/or anchor 104 may comprise fire retardant material. In this way, for example, the cover 100 may be used as a cooking or eating instrument, such as a bowl to hold boiling water, although not limited thereto.

Although the present teachings have been discussed in terms of hiking boots, it is to be appreciated that any type of footwear may be used. For example, the present teachings could be used with camping boots, dress boots, hunting boots, riding boots, sport boots (e.g., ski, snowboard), etc., although not limited thereto.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. The combination of a boot and a boot top opening covering system, comprising:

a boot having a sole, tongue, an upper portion having a top opening, and laces;

a boot top opening covering system having:

a pouch having two ends, and a length between the two ends, the two pouch ends each having an attachment member, and a fastener for alternately opening and closing the pouch;

an anchor having two ends, and a length between the two anchor ends, the two anchor ends each having an attachment member, the anchor having one or more loops, with the boot laces extending through the anchor one or more loops and engaged therewith to secure the anchor to a front of the upper portion of the boot, with the anchor and two anchor ends with attachment members extending across a width of the boot tongue; and a flexible cover which is sized to be contained in the pouch, the cover being sized to fit over and around the top opening of the boot, having a tightening member around a perimeter of the cover, the cover being contained in and removable from the pouch to cover the top opening of the boot;

wherein the attachment members of the two ends of the anchor are removeably engageable with the attachment members of the two ends of the pouch, the anchor and pouch having a combined length such that the anchor and pouch extend around the upper portion of the boot, the pouch attachment members being attached to the anchor attachment members, whereby the pouch is positioned at a rear of the upper portion of the boot;

wherein the cover is fitted to and covers the top opening of the boot and the upper portion of the boot with the tightening member securing the cover around the upper portion of the boot.

2. The combination of claim 1, wherein the boot comprises a sporting boot.

3. The combination of claim 2, wherein the sporting boot comprises a ski boot.

4. The combination of claim 1, wherein the boot comprises a hiking boot.

5. The combination of claim 1, further comprising one or more survival gear items contained in the pouch.

6. The combination of claim 1, wherein one of the attachment members of the two ends of the anchor or of the two ends of the pouch comprises a whistle side release buckle.

7. The combination of claim 1, wherein the tightening member comprises a cord lock securing an elastic drawstring.

8. The combination of claim 1, wherein the fastener for alternately opening and closing the pouch comprises a zipper.

9. The combination of claim 1, wherein the attachment members of the two ends of the anchor and the attachment members of the two ends of the pouch comprise side release buckles.

10. The combination of claim 1, wherein the cover comprises a water resistant material capable of holding water.

11. The combination of claim 1, wherein the pouch comprises a water resistant material capable of holding water.

12. The combination of a boot and a boot top opening covering system, comprising:

a boot having a sole, tongue, an upper portion having a top opening, and laces;

a boot top opening covering system having:

a pouch having two ends, and a length between the two ends, the two pouch ends each having an attachment member, and a fastener for alternately opening and closing the pouch;

an anchor having two ends, and a length between the two anchor ends, the two anchor ends each having an attachment member;

the anchor having one or more loops, with the boot laces extending through the anchor one or more loops and being engaged therewith to secure the anchor to a front of the upper portion of the boot, with the anchor and two anchor ends with attachment members extending across a width of the boot tongue;

the attachment members of the two ends of the anchor being removeably engageable with the attachment members of the two ends of the pouch, the anchor and pouch having a combined length such that the anchor and pouch extend around the upper portion of the boot, the pouch attachment members being attached to the anchor attachment member, whereby pouch is positioned at a rear of the upper portion of the boot; and a flexible cover sized to fit over and cover the top opening of the boot and the upper portion of the boot, the cover having a tightening member around a perimeter thereof, the tightening member being sized to snugly secure the cover to the upper portion of the boot, the cover being contained in and removable from the pouch.

13. The combination of claim 12, wherein the tightening member comprises a cord lock securing an elastic drawstring.

14. The combination of claim 12, wherein the fastener for alternately opening and closing the pouch comprises a zipper.

15. The combination of claim 12, wherein the attachment members of the two ends of the anchor and the attachment members of the two ends of the pouch comprise side release buckles.

16. The combination of claim 12, wherein the cover comprises a water resistant material capable of holding water.

17. The combination of claim 12, wherein the pouch comprises a water resistant material capable of holding water.

18. The combination of claim 12, further comprising one or more survival gear items contained in the pouch.

19. The combination of claim 12, wherein one of the attachment members of the two ends of the anchor or of the two ends of the pouch comprises a whistle side release buckle.

* * * * *